US005820472A

United States Patent [19]

Briggs

[11] Patent Number: 5,820,472

[45] Date of Patent: Oct. 13, 1998

[54] PORTABLE WATERPLAY STRUCTURE

[76] Inventor: Rick A. Briggs, 64 Maple Grove, Springfield, Ill. 62707

[21] Appl. No.: 843,783

[22] Filed: Apr. 21, 1997

Related U.S. Application Data

[63] Continuation of Ser. No. 466,536, Jun. 6, 1995, Pat. No. 5,649,867.

[51] Int. Cl.[6] ..... A63G 21/00

[52] U.S. Cl. ..... 472/128; 482/35

[58] Field of Search ..... 472/117, 128, 472/35–37; 482/3 S

[56] References Cited

U.S. PATENT DOCUMENTS

| | | |
|---|---|---|
| D. 241,664 | 9/1976 | Ewers et al. . |
| D. 250,782 | 1/1979 | Dieter et al. . |
| D. 250,784 | 1/1979 | Dieter et al. . |
| D. 330,579 | 10/1992 | Briggs . |
| D. 357,299 | 4/1995 | Laing et al. . |
| 1,648,196 | 11/1927 | Rohmer . |
| 3,539,181 | 11/1970 | Larsen et al. . |
| 3,752,472 | 8/1973 | Snead . |
| 4,057,244 | 11/1977 | Gaspar . |
| 4,145,042 | 3/1979 | Becker et al. . |
| 4,149,710 | 4/1979 | Rouchard et al. . |
| 4,573,679 | 3/1986 | Janszen . |
| 4,799,665 | 1/1989 | Bracy et al. . |
| 4,805,897 | 2/1989 | Dubeta . |
| 4,805,898 | 2/1989 | Jacober et al. . |
| 5,194,048 | 3/1993 | Briggs . |
| 5,213,547 | 5/1993 | Lochtefeld . |
| 5,256,120 | 10/1993 | Howell . |
| 5,378,197 | 1/1995 | Briggs . |
| 5,385,472 | 1/1995 | Mullin . |
| 5,401,214 | 3/1995 | Smoller et al. . |
| 5,405,294 | 4/1995 | Briggs . |
| 5,480,336 | 1/1996 | Blanchard . |
| 5,649,867 | 7/1997 | Briggs ..... 472/128 |

FOREIGN PATENT DOCUMENTS

| | | |
|---|---|---|
| 1031693 | 6/1958 | Germany . |
| 3812435 | 9/1989 | Germany . |
| 2048088 | 12/1980 | United Kingdom . |

OTHER PUBLICATIONS

SCS Company brochures of models 107. 108. 110. 112. 115. 212. 245. 333 and 400.
Picture of Mexico Forge. 300 Series Model 3813–311.
Picture of Sandman Playground Equipment/ The Christina.
Pictures of Braunfelsbilt Products.
Pamphlet of SCS Interactive Family Adventures.

*Primary Examiner*—Beth Aubrey
*Attorney, Agent, or Firm*—Knobbe, Martens, Olson & Bear, LLP

[57] ABSTRACT

A waterplay structure is provided for home use which is easily assembled and which provides a variety of interactive water forming devices and adjustment valves for exciting backyard play. Play participants can assemble the play structure and then control the various water effects to cool and entertain the whole family.

56 Claims, 3 Drawing Sheets

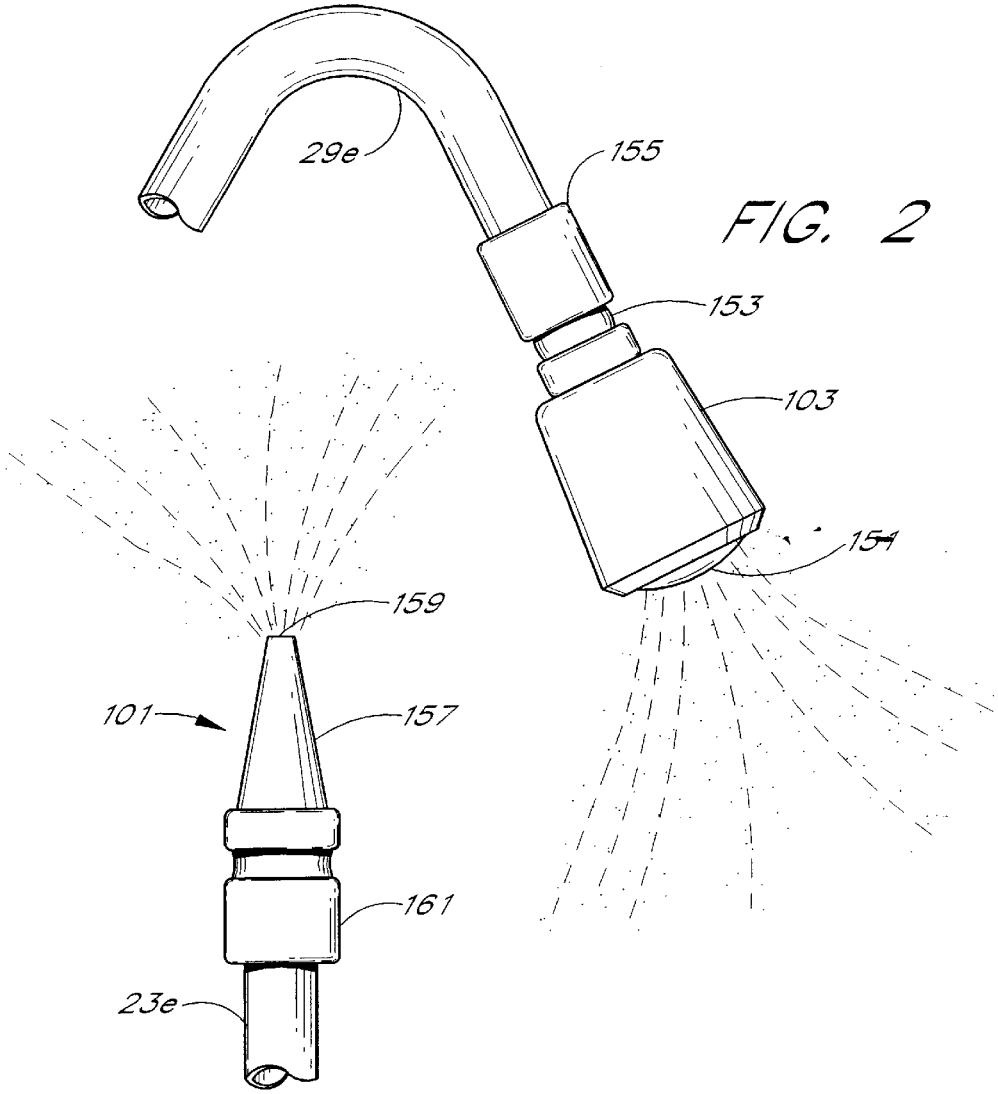
FIG. 2
FIG. 3
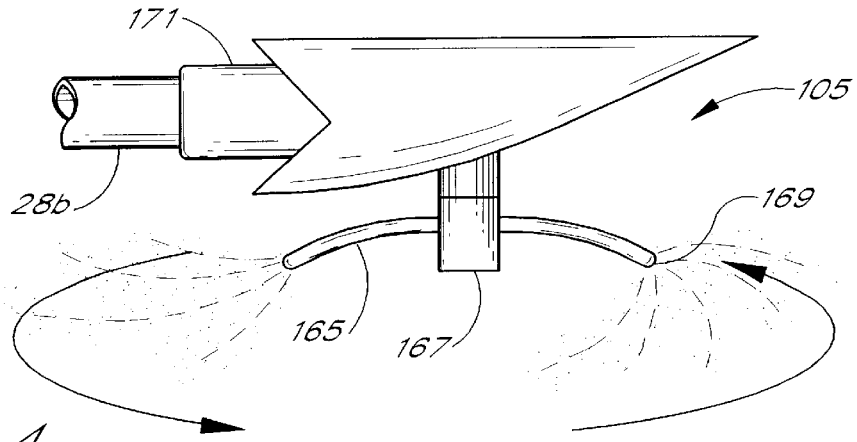
FIG. 4

PORTABLE WATERPLAY STRUCTURE

This application is a continuation of U.S. application Ser. No. 08/466,536, filed Jun. 6, 1995, now U.S. Pat. No. 5,649,867.

BACKGROUND OF THE INVENTION

1. Field of the Invention

The present invention relates to waterplay structures, and, in particular, to a portable waterplay structure for providing interactive waterplay entertainment and education of small and intermediate-age children.

2. Description of the Related Art

The popularity of recreational water attractions has increased dramatically over the last decade. Water theme parks have proliferated as adults and children, alike, seek the thrill and entertainment of waterplay as a healthy and enjoyable way to cool off in the hot summer months. Small children, particularly, can benefit from the fun learning experiences garnered from interactive waterplay. See, for instance, my copending U.S. patent application Ser. No. 08/409,133 filed Mar. 23, 1995, incorporated herein by reference as though fully reproduced herein.

My U.S. Pat. No. 5,194,048 and related design patent D330,579, both of which are incorporated herein by reference as though fully reproduced herein, first disclosed the concept of "interactive waterplay," in which play participants can operate any one of a number of valves to adjust the amount of water spraying from one or more associated water effects. Play participants adjust the various valves and can immediately observe the change in the rate of water flowing from the various associated water effects. This allows children to experiment with and learn about cause-and-effect reactions using a familiar and entertaining medium, namely water.

Many large-scale successful commercial water parks now incorporate interactive waterplay structures of the type disclosed in my U.S. Pat. No. 5,194,048. Families that have patronized these commercial water parks have discovered for themselves the valuable entertainment and educational benefits that interactive waterplay provides. Sales of admission tickets for many such commercial water parks have surged following the introduction of a new interactive waterplay structure.

Many families, however, particularly low-income families or families with multiple dependent children, have not been able to experience the benefits of interactive waterplay because they simply cannot afford the entrance fees required for a day of family entertainment at a commercial water theme park. Some families who can afford to go to a commercial water park do not because it is inconvenient or they object to the crowds and long lines often encountered at large-scale commercial water parks. Other families simply prefer to play in the comfort and convenience of their own home.

Home waterplay typically comprises a passive body of water contained in a swimming pool or inflatable wading pool provided in the backyard. Active home waterplay devices may include a spray nozzle, sprinkler or similar spray device attached to a garden hose and perhaps used in conjunction with a plastic mat on which play participants may slide and play. Others have proposed connecting a backyard swing set to a garden hose so as to continuously spray water down upon play participants.

While each of these home waterplay devices may cool play participants, they fail to provide the creative stimulation and interactive educational experience that captivates the imaginations of small and intermediate-age children.

SUMMARY OF THE INVENTION

Accordingly, it is an object of the present invention to provide a low-cost interactive waterplay structure that allows children of nearly all ages to play together in the comfort and convenience of their own back yards and to combine their creative inspiration and imaginations to achieve various desired water effects. It is a further object of the present invention to provide a portable waterplay structure that attaches to an ordinary garden hose or other convenient source of water for entertaining small and intermediate age children. It is a further object of the present invention to provide a portable waterplay structure that may be disassembled and transported and/or stored. It is a further object of the present invention to provide a waterplay structure that can be assembled by play participants themselves to create a variety of creative waterplay structures which may be enjoyed by the entire family.

In accordance with one embodiment of the present invention, a low-cost waterplay structure is provided which can be used with an ordinary garden hose or other convenient source of water to cool and entertain play participants. The waterplay structure comprises a frame formed from a plurality of interconnected conduit members. The frame has at least one connector adapted to receive the male end of a garden hose or other water source. A plurality of longitudinally spaced openings are formed on at least one conduit member for spraying streams of jetted water in a horizontal spray pattern. A plurality of longitudinally spaced openings are formed on at least one other conduit member for spraying streams of jetted water in a vertical spray pattern. A control valve is provided on the frame for allowing play participants to control the amount of water issuing from the various perforated conduit members.

In accordance with another embodiment of the present invention a portable interactive waterplay structure is provided for cooling and entertaining play participants. The waterplay structure comprises a frame formed from a plurality of interconnected conduit members adapted to be connected to a garden hose or other source of water under pressure. A plurality of water forming elements are disposed on the frame at various locations for selectively spraying water onto play participants and/or for creating desired water effects. A plurality of corresponding control valves are also disposed on the frame at various locations for allowing play participants to independently adjust the amount of water issuing from each of the water forming elements.

In accordance with yet another embodiment of the present invention a waterplay structure is provided comprising a plurality of conduit members and connector members adapted to be connected together to form a substantially freestanding frame. At least one hose receiving member is provided for connecting the frame to a garden hose or other source of water under pressure. A plurality of water forming elements are disposed at various locations on said frame for spraying water onto play participants and/or for creating desired water effects. A corresponding plurality of control valves are provided interposed in the flow path of water through the various conduit members for allowing play participants to adjust the amount of water provided to each of said water forming elements.

In accordance with yet another embodiment of the present invention a children's waterplay toy is provided for allowing play participants to design and construct a waterplay structure for cooling and entertaining play participants. The waterplay toy comprises a plurality of conduit members and connector members having different sizes, shapes and/or colors and adapted to be connected together to form a frame. At least one hose receiving member is provided for connecting the frame to a garden hose or other source of water under pressure. A plurality of water forming elements are provided adapted to be assembled on the frame at various locations for spraying water onto play participants and/or for creating desired water effects. A plurality of control valves are also provided adapted to be assembled on the frame interposed in the flow path of water through the various conduit members for allowing play participants to adjust the amount of water provided to the various water forming elements. Participants can assemble the conduit members, connector members, water forming elements and control valves together to form a waterplay structure for cooling and entertaining the whole family.

These and other objects and advantages of the present invention will become readily apparent to those skilled in the art from the following detailed description of the preferred embodiments having reference to the attached drawings. These drawings are provided for purposes of illustration only and should not be construed as limiting in any way the scope of the invention disclosed herein.

BRIEF DESCRIPTION OF THE DRAWINGS

FIG. 2 is a detail perspective view of an interactive waterplay element in the form of a shower head nozzle;

FIG. 3 is a detail perspective view of an interactive waterplay element in the form of a vertical spray nozzle;

FIG. 4 is a detail perspective view of an interactive waterplay element in the form of a spiralling water spout;

DETAILED DESCRIPTION OF THE PREFERRED EMBODIMENTS

Figure 1:
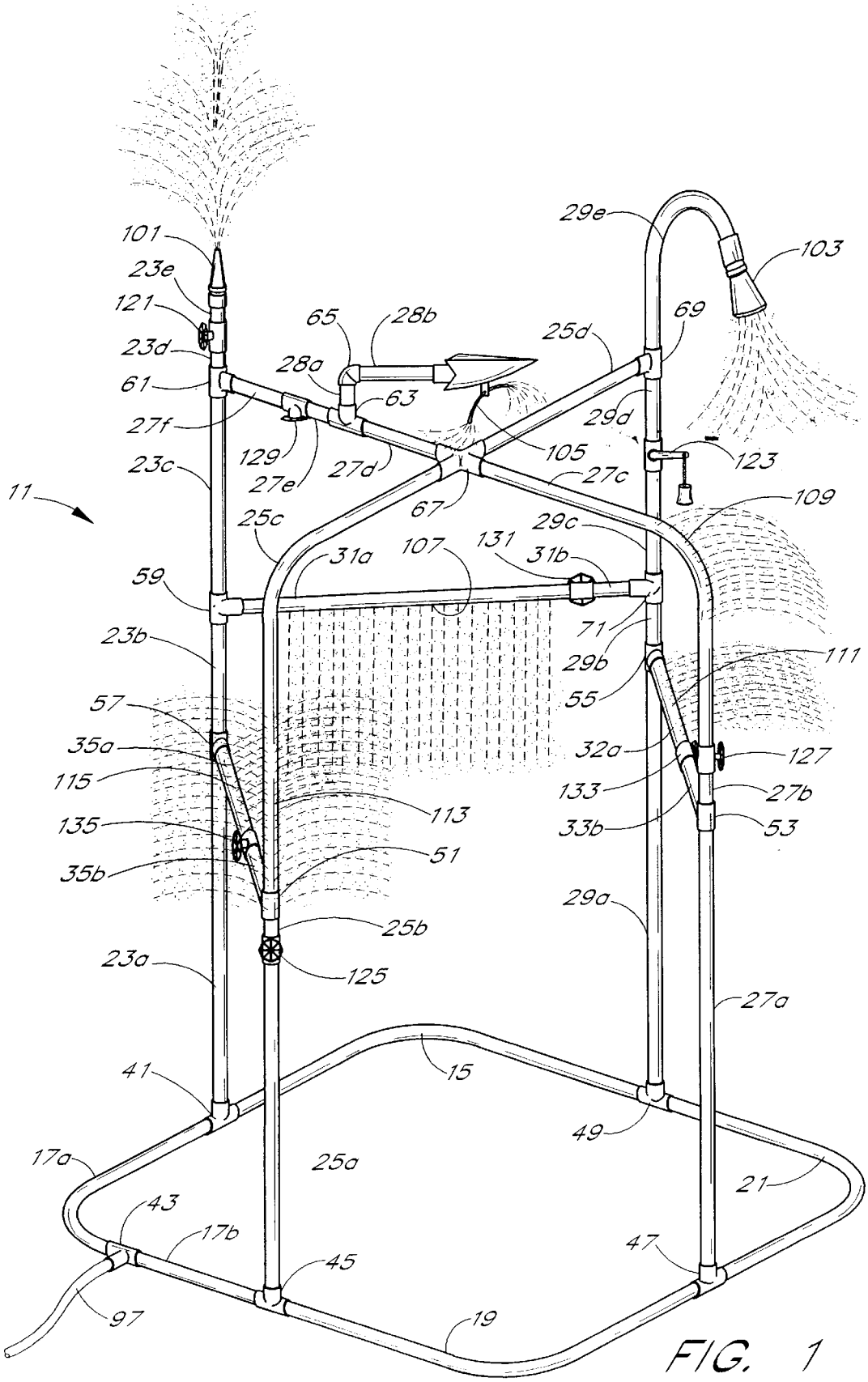
FIG. 1 is a front perspective view of a portable waterplay structure having features in accordance with the present invention.

FIG. 1 illustrates one embodiment of a portable waterplay structure constructed in accordance with the present invention. The preferred play structure generally comprises a lightweight frame 11 formed of a plurality of interconnected water conduit members 15–35, connector members 41–71 water forming elements 101–115 and corresponding control valves 121–135. This particular waterplay structure is provided in the form of an open, three-dimensional rectangular structure, as shown, having an overall height of about 4–8 ft. Of course, those skilled in the art will readily appreciate that the waterplay structure of the present invention is not limited to this one preferred embodiment, but may be implemented in accordance with a wide variety of other possible shapes, dimensions and sizes.

It is envisioned, for instance, that the frame 11 may be configured to form circular, oval, spherical, cylindrical, cone-shaped or dome-shaped structures, as desired. Alternatively, the frame 11 may be configured to resemble or imitate familiar objects such as vehicles or animals, including without limitation, a fire house, police station, space station, igloo, fire engine, locomotive, space ship, pirate ship, whale, dinosaur or any other play shape, as desired. Alternatively, the frame 11 may comprise a randomly winding or intertwined two-dimensional or three-dimensional play structure or any other shape that children may find entertaining. One or more optional decorative panels (not shown) may also be incorporated into the structure, as desired, to assist in defining a particular desired shape.

In yet another embodiment, various components making up the frame 11 may be provided in a construction kit which play participants can assemble to create any one of a number of different play structures. In effect, the kit may comprise various waterplay "building blocks" which play participants can assemble and connect to a garden hose or other convenient source of water to create new and exciting waterplay structures. Multiple kits may be combined, if desired, to produce even larger and more spectacular waterplay structures. It will be readily appreciated by those skilled in the art that the combination of possible play structures 11 is virtually unlimited.

Conduit members 15–35 may comprise any one of a number of hollow pipe structures well know to those skilled in the art. Polyvinyl chloride (PVC) pipes are particularly preferred because of their light weight, durability and low cost. Of course, other durable materials such as plastic, fiberglass, ceramic, copper or galvanized steel may also be used to form conduit members 15–35 as the particular application permits. Alternatively, one or more water conduit members 15–35 may comprise a non-rigid conduit provided inside a structurally rigid frame element, as desired.

Water conduits 15–35 are preferably round in shape having an outer diameter of between about ¼ and 3 inches and, more preferably, between about ¾ and 1½ inches, and most preferably, about 1 inch. This ensures adequate volume of water flow and water pressure throughout the play structure. Alternatively, other conduit shapes and sizes may be used while still enjoying the benefits of the invention herein disclosed. For example conduit members having an oval, triangular or square cross-section may be used, as desired. Conduit members having non-uniform cross-sections may also be used to simulate, for example, a bamboo or treehouse structure, a high-tech outer-space structure or other play structure, as desired. Multi-colored and/or textured conduit members may also be used as desired to add to the visual appeal of the structure and/or to aid in its assembly.

Adjacent interconnected water conduit members may be connected to one another using any one of a number of wellknown pipe-joining devices or techniques available to those skilled in the art, including without limitation threaded assembly, press-fit, gluing, heat welding, ultra-sonic welding, chemical welding or bonding, as desired. Threaded assembly is preferred, however, such that the frame 11 may be disassembled, stored and/or transported between uses. Alternatively, it is envisioned that adjacent interconnected water conduit members may be connected to one another by way of a snap-coupling.

Beginning at the bottom, it may be seen that the frame 11 has a nearly square base, as shown, comprising interconnected conduit members 15, 17*a*, 17*b*, 19 and 21. With the exception of the shortest conduit member 17*b*, each of the conduit members comprising the base of the frame 11 is formed in the shape of a 90 degree elbow, as shown. Those skilled in the art will readily appreciate that bending may be accomplished by heating a PVC or plastics pipe and then bending it into the desired shape.

A plurality of threaded T-connector elements 41, 43, 45, 47 and 49 are provided for threadingly engaging corresponding mating conduit members 15, 17, 19 and 21 comprising the base. Each of the threaded T-connector elements has two axially aligned openings and a third opening formed perpendicularly to the first two. Those skilled in the art will readily appreciate that each of the openings in the T-connector elements 41, 43, 45, 47 and 49 has internal threads formed therein for threadingly engaging corresponding male threads formed on the end of each adjacent conduit member 15, 17*a*, 17*b*, 19 and 21.

The T-connector element 43 has at least one opening adapted to receive the threaded male end of a standard lawn or garden hose 97. Optionally, the T-connector element 43 may include a rotatable collar (not shown) for threadingly engaging the threaded male end of a garden hose without having to twist the hose. Preferably, the hose-receiving T-connecter element 43 is disposed on the base of the frame 11, as shown, so that play participants will not trip over the hose 97 while playing in and around the play structure 11.

Alternatively, those skilled in the art will readily appreciate that the play structure 11 may be connected to any convenient source of water under pressure, such as a water spigot, recirculating pump, swimming pool recirculation system or the like. To conserve water and avoid possibly damaging run-off, the play structure 11 may be placed in a pool receptacle or basin in order to collect run-off water and recirculate it through the frame 11 via a recirculation pump. For an in-ground swimming pool or filtered above-the-ground pool, the play structure 11 may be placed in the pool either in the shallow end thereof or on one or more floats. In that case, water may be provided to the play structure 11 via either a garden hose or via a hose connected to the swimming pool recirculation/filter system.

It will be readily appreciated by those skilled in the art that the various conduit members 15, 17*a*, 17*b*, 19, 21 comprising the base portion of the frame 11 provide a common rail or manifold for delivering pressurized water to the remaining portions of the frame 11. If desired, the conduit members 15–21 forming the base of the frame 11 may be of a larger internal diameter than other conduit members comprising the frame 11 in order to balance the flow of water and pressure in the frame 11. Alternatively, one or more flow restricters or orifices (not shown) may be provided in the flow path of water through one or more of the conduit members in order to help balance the flow of water to the various water effects in accordance with well known principles of hydrodynamics.

Four vertical conduit members 23, 25, 27 and 29 are connected to the base of the frame via T-connectors 41, 45, 47 and 49, as shown. Conduit member 23 extends substantially straight up, terminating in an upward directed spray nozzle 101. The spray nozzle 101 may comprise any one of a number of commonly available nozzles having either a fixed or adjustable spray pattern. Those skilled in the art will readily appreciate that conduit member 23 actually comprises a plurality of component members 23*a*–23*e* connected together using threaded T-connector elements 57, 59 and 61. A wheel operated control valve 121 is connected between the highest two conduit members 23*d* and 23*e* interposed in the flow path of water therethrough for allowing play participants to control the amount of water issuing from the spray nozzle 101. The control valve 121 may comprise any number of commercially available valves well known to those skilled in the art. These may include, for example, wheel-controlled butterfly valves, lever-controlled butterfly valves, counter-weight valves, gate valves, flush valves, wheel-controlled ball valves, lever-controlled ball valves, and any number of other control valves well know to those skilled in the art. A standard 1 inch diameter in-line ball valve should be suitable for most purposes.

Conduit member 29 extends substantially upward in a cane shape, as shown, terminating in a downward directed shower head 103. Again, those skilled in the art will readily appreciate that conduit member 29 actually comprises a plurality of component members 29*a*–29*e* connected together using threaded T-connector elements 55, 69 and 71. The shower head 103 may comprise any number of commercially available shower heads such as for home bathroom use. A swivel-type shower head is preferred having a 1 inch threaded opening for receiving the male end of conduit member 29*e*. A pull-chain actuated valve 123 is connected in series between conduit members 29*c* and 29*d* for allowing play participants to control the water spraying from the shower head 103. A spring-loaded lever actuated valve and pull-chain should be suitable for most purposes. Alternatively, pump levers, hand cranks and other actuators well known to those skilled in the art may be used to enjoy the benefits of the invention herein disclosed.

Conduit members 25 and 27 extend upward and bend at 90 degrees before criss-crossing via a four-way connector plug 67. Again, those skilled in the art will readily appreciate that conduit members 25 and 27 actually comprises a plurality of component members 25*a*–25*d* and 27*a*–27*f* connected together using connector elements 51, 53 and 63 and connector plug 67. Conduit member 25*c* has a series of longitudinally spaced apertures 113 formed on the lower end thereof forming horizontal water jets for spraying streams of water to the left and right, as shown. A wheel operated control valve 125 is connected in series between conduit members 25*a* and 25*b* for allowing play participants to adjust the amount of water issuing from the water jets 113. The connector plug 67 preferably does not provide for passage of water between adjacent conduit members 25*c* and 25*d* such that valve 123 will not be bypassed by operation of valve 125.

Conduit member 27*c* has a series of apertures 109 formed on the 90 degree bend portion forming peacock water jets for spraying streams of water in a radially fanning pattern, as shown. A wheel operated control valve 127 is connected in series between conduit members 27*b* and 27*c* for allowing play participants to selectively adjust the amount of water issuing from the water jets 109. Again, the connector plug 67 preferably does not provide for passage of water between adjacent conduit members 27*c* and 27*d* such that valve 127 cannot be bypassed.

On the other side of the four-way connector plug 67 conduit members 27*d* and 27*e* connect to a T-connector member 63 and a wheel operated control valve 129. Conduit members 28*a* and 28*b* and right-angle connector member 65 connect between the T-connector member 63 and an overhead spiraling water spout 105. The spiralling water spout 105 may be of a type commercially available in the art such as for lawn and garden use. A two-arm spiraling lawn sprinkler having a 1 inch threaded opening should be suitable for most purposes. Play participants control the amount of water issuing from the spiraling water spout 105 by adjusting the control valve 129.

Horizontal conduit members 31, 33 and 35 connect between adjacent vertical conduit members 23, 25, 27 and 29, as shown, to provide support to the frame 11 and to provide additional water effects. Conduit member 31*a* has a series of apertures 107 thereon forming downward directed water jets for spraying a curtain of water downward from the conduit 31, as shown. A wheel operated control valve 131 is connected between conduit members 31*a* and 31*b* for allowing play participants to control the amount of water spraying from the water jets 107. Conduit member 33*a* has a series of apertures 111 thereon forming horizontal water jets for spraying a series of arching streams of water to the right, as shown. A wheel operated control valve 133 is connected between adjacent conduit members 33*a* and 33*b* for allowing play participants to control the amount of water spraying from the water jets 111. Conduit member 35*a* has a series of apertures 115 thereon forming horizontal water jets for spraying a series of arching streams of water to the right, as shown. A wheel operated control valve 135 is connected between conduit members 35*a* and 35*b* for allowing play participants to control the amount of water spraying from the water jets 115. Preferably, at least one side of the frame is open from top to bottom, as shown, so as to allow play participants to enter the play structure 11.

Those skilled in the art will appreciate that the various water forming elements and valve actuators on the frame 11 allow play participants to selectively discharge water onto themselves or other play participants and/or to create various water effects. Preferably, the valves allow independent control of the water discharged from each of the various water forming elements. Alternatively, it is envisioned that one or more valves may be combined to control one or more water forming elements such that play participants may be required to experiment with different valve combinations in order to operate the various water effects. The result is a fun and entertaining learning experience as play participants experience and observe the resultant changes in the look, sound, and feel of the water issuing from the various water forming elements.

FIGS. 2–6 are detail views of the various water forming elements shown in FIG. 1. FIG. 2 shows an adjustable shower head 103 having a plurality of openings 151 formed in the discharge end thereof forming a multi-orifice nozzle for producing a shower spray or sprinkle. The shower head 103 preferably includes a swivel ball 153 for allowing play participants to adjust the angle of the shower head 103. A threaded collar connects the shower head 103 to the adjacent cane shaped conduit member 29*e*.

FIG. 3 shows a vertically oriented spray nozzle 101 for creating an upward directed water spout. The spray nozzle 101 comprises a generally conical shaped body. 157 having an opening 159 formed at the discharge end thereof for spraying a stream of water upward into the air, as shown. A threaded collar 161 connects the nozzle 101 to an adjacent conduit member 23*e*. Optionally, the nozzle body 157 may be adapted to rotate to allow play participants to adjust the spray pattern from a fine mist to a coarse stream in accordance with well known principles of nozzle design.

FIG. 4 shows a spiraling water spout 105 having a pair of opposed arms 165 mounted on a rotatable hub 167. Each of the arms 165 has a plurality of openings formed in the terminal end thereof for spraying streams of water, as shown. Those skilled the art will readily appreciate that the momentum transfer resulting from the spraying water causes the arms 165 of the spiraling water spout 105 to rotate in the opposite direction creating a spiraling water effect. A base portion 171 of the spiraling water spout 105 has a threaded opening adapted to connect the water spout 105 to an adjacent conduit member 28*b*.

Figure 5:
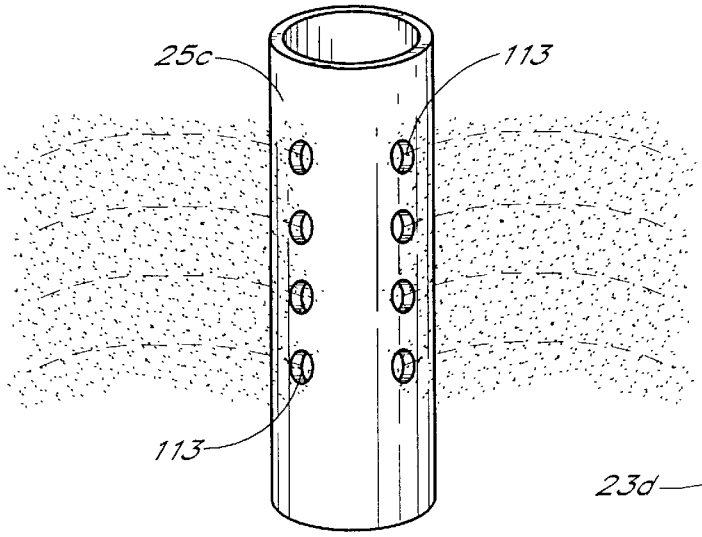
FIG. 5 is a detail perspective view of an interactive waterplay element in the form of horizontal water jets.

FIG. 5 illustrates a series of water jets 113 formed in the conduit member 25*c*. The water jets 113 are preferably formed by drilling a series of apertures or holes in the outer wall surface of the conduit member 25*c*. The holes are positioned longitudinally along the pipe approximately ¼ inches apart and having diameters between about 1/16 and ¼ inches and, more preferably, about ⅛ inches. The particular water jets shown are vertical water jets spraying a substantially vertical array of parallel streams of water to the right and left. Alternatively, water jets may be formed so as to direct water in a horizontal array; upward or downward or in an arching pattern, as desired.

Figure 6:
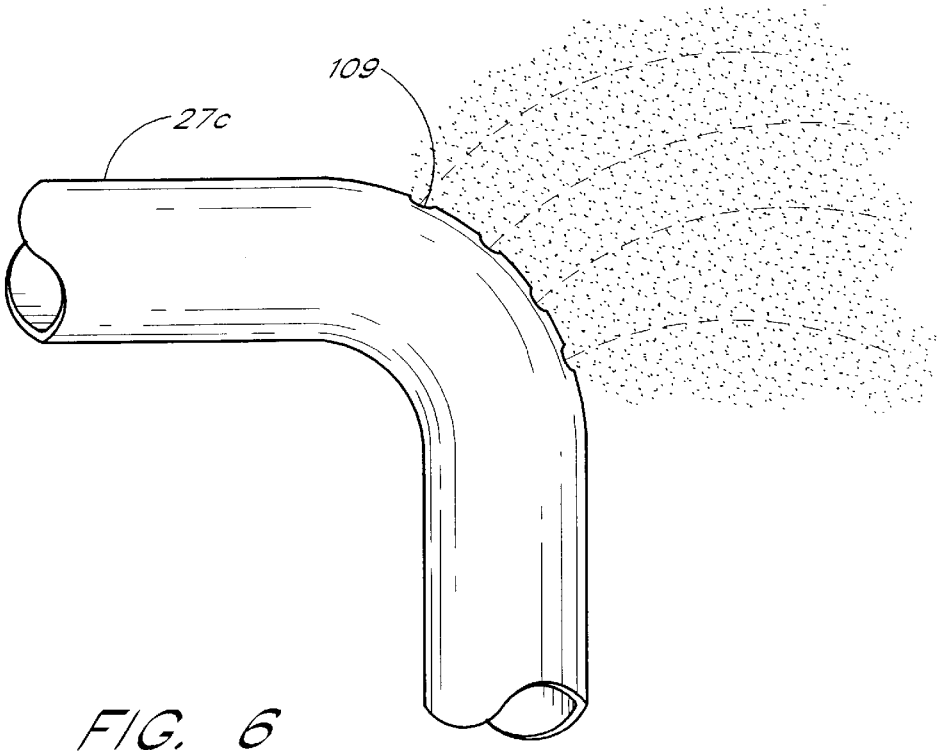
FIG. 6 is a detail perspective view of an interactive waterplay element in the form of peacock water jets.

FIG. 6 show water jets 109 provided on a curved portion of the conduit member 27*c* for providing a peacock spray pattern, as shown. Again, the water jets 109 may be formed by drilling or other convenient expedient. Optionally, any of the above described water jets may comprise any one of a number of commercially available nipple nozzles as are well known in the art.

Figure 7:
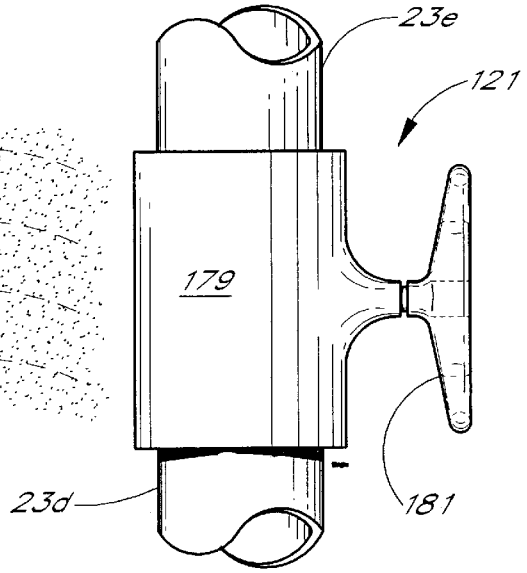
FIG. 7 is a side elevational view of a wheel-controlled valve.

As indicated above, each of the various water forming elements is preferably controlled by an associated valve. Any number of commercially available valves may be used, as desired, such as ball-type valves, butterfly valves, and the like. FIG. 7 shows a standard 1 inch diameter in-line PVC ball valve 121, which should be suitable for most purposes. The valve 121 comprises a cylindrical body or housing 179 which is threaded at both ends for receiving the threaded male ends of adjacent conduit members 23*d* and 23*e*. A wheel actuator 181 is adapted to be rotated by play participants to control the flow of water issuing from the associated water element.

Assembly and Use

Advantageously, the portable waterplay structure in accordance with the present invention is easily assembled at home without special tools. Generally, the individual conduit members 15–35, connector members 41–71; water forming elements 101–115 and corresponding control valves 121–135 may be assembled by threaded engagement and/or chemical bonding or welding means. If desired, color-coding of the various pieces of the structure may be used to aid in its assembly. Optionally, the waterplay structure may be disassembled and reconfigured or recombined in different ways to create a variety of frame shapes and interactive water effects.

If desired, the waterplay structure may be assembled in or adjacent to a wading pool or swimming pool, such that play participants can combine interactive water play with other water activities. Since the waterplay structure in accordance with at least one embodiment of the present invention is relatively lightweight and not fixed to the ground, it may be moved around, stored or transported after assembly, as desired.

Although this invention has been disclosed in the context of certain preferred embodiments, it will be understood by those skilled in the art that the present invention extends beyond the specific disclosed embodiments to other alternative embodiments of the invention. Thus, it is intended that the scope of the present invention herein disclosed should not be limited by the particular disclosed embodiments described above, but should be determined only by reference to the claims that follow.

What is claimed is:

1. A play structure adapted to be connected to a garden hose or other water source comprising:

a plurality of interconnected conduit members forming a play structure;

a plurality of longitudinally spaced openings formed in a first one of said conduit members for spraying streams of jetted water in a horizontal spray pattern;

a plurality of longitudinally spaced openings formed in a second one of said conduit members for spraying streams of jetted water in a vertical spray pattern; and a control valve for controlling the amount, direction, or velocity of water issuing from said plurality of openings.

2. The play structure recited in claim 1, wherein said play structure comprises a three-dimensional structure.

3. The play structure recited in claim 1, wherein said play structure is formed in the shape of an object such as an animal, dwelling or vehicle.

4. The play structure recited in claim 1, wherein said play structure is in the shape of a house or fortress.

5. The play structure recited in claim 1, further including a connector member for accommodating the attachment thereto of a garden hose or other water source.

6. The play structure recited in claim 1, wherein said conduit members comprise PVC or plastic pipes having an outer diameter of between about ¾ and 1½ inches.

7. The play structure recited in claim 1, wherein said conduit members are threadingly coupled to each other.

8. The play structure recited in claim 1, further comprising a plurality of connector members for connecting said conduit members together to form said play structure.

9. The play structure recited in claim 8, wherein said connected members are adapted to connect said conduit members by press-fitting.

10. The play structure recited in claim 8, wherein said connector members are adapted to connect said conduit members by threaded engagement.

11. The play structure recited in claim 1, wherein said control valve has a rotatable actuator adapted to be rotated by play participants to adjust the amount of water issuing from said longitudinally spaced openings.

12. The play structure recited in claim 1, further comprising one or more nozzles mounted on said play structure for spraying water on a play participant.

13. The play structure recited in claim 1, further comprising a showerhead mounted on said play structure for spraying water on a play participant.

14. The play structure recited in claim 1, further comprising a spiraling water spout mounted on said play structure for spraying water on a play participant.

15. A portable play structure for cooling and entertaining play participants, said play structure comprising:

a frame comprising a plurality of interconnected conduit members, said frame adapted to be connected to a garden hose or other convenient source of water;

a plurality of water forming elements disposed on said frame for selectively spraying water in a desired pattern; and a plurality of control valves disposed on said frame, each of said control valves having a corresponding valve actuator for allowing play participants to adjust the amount, direction or velocity of water issuing from each of said water forming elements.

16. The portable play structure recited in claim 15, wherein said frame comprises a three-dimensional structure.

17. The portable play structure recited in claim 15, wherein said frame is formed in the shape of a play object such as an animal, dwelling or vehicle.

18. The portable play structure recited in claim 15, wherein said frame includes a connector member for accommodating the attachment thereto of a garden hose or other water source.

19. The portable play structure recited in claim 15, wherein said conduit members comprise PVC or plastic pipes having an outer diameter of between about ¾ and 1½ inches.

20. The portable play structure recited in claim 15, wherein said conduit members are of different sizes, shapes and colors.

21. The portable play structure recited in claim 15, wherein said conduit members are threadingly coupled to each other.

22. The portable play structure recited in claim 15, further comprising a plurality of connector members for connecting said conduit members together to form said frame.

23. The portable play structure recited in claim 15, wherein at least one of said water forming elements comprises a conduit member having a plurality of longitudinally spaced openings formed in an outer wall thereof for spraying streams of jetted water.

24. The portable play structure recited in claim 15, wherein at least one of said water forming elements comprises a nozzle.

25. The portable play structure recited in claim 15, wherein at least one of said water forming elements comprises a spiraling water spout.

26. The portable play structure recited in claim 15, wherein at least one of said water forming elements comprises a showerhead.

27. The portable play structure recited in claim 15, wherein at least one of said control valves has a rotatable actuator adapted to be rotated by play participants to adjust the amount of water issuing from one or more of said water forming elements.

28. A play structure for cooling and entertaining play participants, said play structure comprising:

a plurality of conduit members adapted to be connected to a source of water under pressure;

a plurality of connector members adapted to connect said conduit members together to form a substantially free-standing frame;

a plurality of water forming elements disposed at various locations and elevations on said frame for spraying water in a plurality of directions; and a plurality of control valves interposed in the flow path of water through said conduit members, each of said control valves having a corresponding valve actuator for allowing play participants to adjust the amount of direction or velocity of water provided to each of said water forming elements.

29. The play structure recited in claim 28, wherein said frame is formed in the shape of a play object such as an animal, dwelling or vehicle.

30. The play structure recited in claim 28, wherein said conduit members comprise plastic or PVC pipes.

31. The play structure recited in claim 28, wherein said conduit members, connector members, water forming elements and control valves are of different sizes, shapes and colors.

32. The play structure recited in claim 28, wherein said conduit members have threaded male ends and said connector members have threaded female ends whereby said frame may be formed by threading said conduit members into said connector members.

33. The play structure recited in claim 28 wherein said connector members comprise threaded T-connectors or corner-connectors.

34. The play structure recited in claim 28, wherein at least one of said water forming elements comprises a conduit member having a plurality of longitudinally spaced openings formed in an outer wall thereof for spraying streams of jetted water.

35. The play structure recited in claim 28, wherein at least one of said water forming elements comprises a nozzle.

36. The play structure recited in claim 28, wherein at least one of said water forming elements comprises a spiraling water spout or rotating sprinkler.

37. The play structure recited in claim 28, wherein at least one of said water forming elements comprises a shower head.

38. The play structure recited in claim 28, wherein at least one said control valves has rotatable actuator adapted to be rotated by play participants to adjust the amount of water issuing from one or more of said water forming elements.

39. A children's play toy for allowing play participants to design and construct a play structure for spraying water, said play toy comprising:

a plurality of conduit members;

a plurality of connector members adapted to connect said conduit members together to form a play structure;

means for connecting said play structure to a source of water;

a plurality of water forming elements adapted to be assembled on said play toy at various locations for spraying water; and a plurality of control valves adapted to be interposed in the flow path of water through said conduit members, said control valves having valve actuators for allowing play participants to adjust the amount of water provided to said water forming elements;

whereby play participants can assemble said conduit members, connector members, water forming elements and control valves to form a play structure for cooling and entertaining play participants.

40. The play toy recited in claim 39, wherein said connecting means comprises at least one hose receiving member for accommodating the attachment thereto of a garden hose or other source of water under pressure.

41. The play toy recited in claim 40, wherein said hose receiving member comprises a rotatable collar adapted for threaded engagement with the threaded male end of a garden hose.

42. The play toy recited in claim 34 wherein said conduit members comprise PVC or plastic pipes.

43. The play toy recited in claim 39, wherein said conduit members are of different colors according to size and shape.

44. The play toy recited in claim 39, wherein said connector members are of different colors according to size and shape.

45. The play toy recited in claim 39, wherein said conduit members have threaded male ends and said connector members have threaded female ends whereby said play structure may be formed by threading said conduit members into said connector members.

46. The play toy recited in claim 39, wherein said connector members comprise threaded T-connectors or corner-connectors.

47. The play toy recited in claim 39, wherein at least one of said water forming elements comprises a conduit member having a plurality of longitudinally spaced openings formed in an outer wall thereof for spraying streams of jetted water.

48. The play toy recited in claim 39, wherein at least one of said water forming elements comprises a nozzle.

49. The play toy recited in claim 39, wherein at least one of said water forming elements comprises a spiraling water spout or rotating sprinkler.

50. The play toy recited in claim 39, wherein at least one of said water forming elements comprises a shower head.

51. The play toy recited in claim 39, wherein at least one said control valves has a rotatable actuator adapted to be rotated by play participants to adjust the amount of water issuing from one or more of said water forming elements.

52. The play structure recited in claim 1, further comprising one or more nozzles mounted on said play structure for creating desired water effects.

53. The play structure recited in claim 1, further comprising a showerhead mounted on said play structure for creating desired water effects.

54. The play structure recited in claim 1, further comprising a spiraling water spout mounted on said play structure for creating desired water effects.

55. The play toy recited in claim 39, wherein said conduit members are of different colors according to shape.

56. The play toy recited in claim 39, wherein said connector members are of different colors according to shape.

* * * * *